US005810037A

United States Patent [19]

Sasaki et al.

[11] Patent Number: 5,810,037

[45] Date of Patent: Sep. 22, 1998

[54] ULTRASONIC TREATMENT APPARATUS

[75] Inventors: Takayoshi Sasaki; Kotaro Kashiyama, both of Nagoya, Japan

[73] Assignee: Daido Metal Company Ltd., Nagoya, Japan

[21] Appl. No.: 499,161

[22] Filed: Jul. 7, 1995

[30] Foreign Application Priority Data

Jul. 22, 1994 [JP] Japan ..... 6-191746

[51] Int. Cl.[6] ..... B08B 3/10

[52] U.S. Cl. ..... 134/111; 134/184; 96/174

[58] Field of Search ..... 95/174, 157, 161, 95/166; 210/750; 134/184, 1, 111

[56] References Cited

U.S. PATENT DOCUMENTS

| | | | |
|---|---|---|---|
| 2,195,898 | 4/1940 | Newton | 96/166 |
| 2,715,450 | 8/1955 | Bliss et al. | 96/174 |
| 2,870,859 | 1/1959 | Topol et al. | 96/174 |
| 2,977,962 | 4/1961 | Zucker | 134/1 |
| 3,213,594 | 10/1965 | Long . | |
| 3,229,445 | 1/1966 | Kraft | 96/157 |
| 3,435,835 | 4/1969 | Hobbs | 134/1 |
| 3,904,392 | 9/1975 | Vaningen et al. . | |
| 4,730,634 | 3/1988 | Russell | 96/174 |
| 5,190,515 | 3/1993 | Eaton et al. | 96/174 |
| 5,372,634 | 12/1994 | Monahan . | |
| 5,509,954 | 4/1996 | Derian et al. . | |

FOREIGN PATENT DOCUMENTS

| | | | |
|---|---|---|---|
| 51-38760 | 10/1976 | Japan | 96/174 |
| 63-221878 | 9/1988 | Japan . | |
| 64-27680 | 1/1989 | Japan . | |
| 4-341341 | 11/1992 | Japan . | |
| 878373 | 11/1981 | U.S.S.R. | 134/1 |

*Primary Examiner*—Frankie L. Stinson
*Attorney, Agent, or Firm*—Browdy and Neimark

[57] ABSTRACT

There is disclosed an ultrasonic cleaning apparatus in which the amount of gas dissolved in a cleaning liquid in a cleaning vessel is reduced, thereby enabling a cleaning operation efficiently. The cleaning liquid stored in the cleaning vessel, cleans articles, immersed therein, by a cavitation phenomenon caused by an ultrasonic vibrator. The cleaning liquid is fed to a degassing vessel by a discharge pump through a discharge pipe, and is returned to the cleaning vessel by a supply pump through a supply pipe. Thus, the cleaning liquid is circulated between the two vessels. Gas, dissolved in the cleaning liquid in the degassing vessel, makes bubbles since the degassing vessel is kept to a vacuum, so that the cleaning liquid containing a reduced amount of dissolved gas is stored in the cleaning vessel. Therefore, bubbles are less produced by the ultrasonic vibrator, and the cleaning operation can be carried out efficiently.

20 Claims, 3 Drawing Sheets

ULTRASONIC TREATMENT APPARATUS

BACKGROUND OF THE INVENTION

1. Field of the Invention

This invention relates to an ultrasonic treatment apparatus for removing oil, grease, stains, burrs and so on adhered on parts, members and so on in which apparatus an ultrasonic vibration energy is applied to a treatment liquid stored in a treatment vessel to cause a cavitation phenomenon (which means the generation and collapse of bubbles occurring on a metal surface when liquid pressure rise-and-decrease occurs locally in a high frequency in a liquid contacting the metal surface by which the parts, members and so on immersed in the treatment liquid are subjected to treatments such as cleaning, rinsing and the removal of burrs.

2. Related Art

An ultrasonic treatment apparatus for removing oil, grease, stains, burrs and so on from the surface of an article to be treated while utilizing a cavitation phenomenon by an ultrasonic vibration energy is widely known in JP-A-63-221878, JP-A-64-27680 and JP-A-4-341341. If gas is dissolved in a treatment liquid, bubbles are formed in the treatment liquid by the ultrasonic vibration energy, and adhere onto the surface of the article to be treated, thereby affecting the above treatment.

Therefore, in order to decrease the dissolved gas concentration in the treatment liquid so as to enhance the treatment efficiency, the following treatment apparatuses are known. In the first apparatus, the treatment liquid is degassed while exposing a treatment vessel to vacuum. The second apparatus is suitable when the treatment liquid is of the solvent type, and the treatment liquid is degassed by boiling it. In the third apparatus, degassing is effected using a gas-liquid separation membrane.

However, the first apparatus suffers from a problem that the efficiency of the operation is low since the degassing operation is of the batch type in which the treatment vessel is evacuated into vacuum each time the article to be treated is introduced into this vessel.

Although the second apparatus effects the continuous treatment, the treatment liquid to be used is limited to solvent-type volatile ones, and therefore has a problem that water desirable from an environmental sanitary point of view, as well as a hydrocarbon cleaning agent of a high boiling point, can not be used.

Although the third apparatus also effects the continuous treatment, it has problems that the speed of treatment (that is, the speed of removal of gas) is low, and that the cost is high because of the use of the expensive gas-liquid separation membrane.

SUMMARY OF THE INVENTION

With the above problems in view, it is an object of this invention to provide an ultrasonic treatment apparatus in which a treatment liquid is circulated between a treatment vessel and a degassing vessel in which gas is to be degassed, so that the amount of gas dissolved in the treatment liquid is reduced, thereby efficiently effecting the ultrasonic treatment continuously.

According to a first aspect of the invention, there is provided an ultrasonic treatment apparatus comprising:

a treatment vessel storing a treatment liquid, the treatment vessel having ultrasonic wave-generating means;

a degassing vessel in the form of a vacuum vessel; and means for circulating the treatment liquid between the treatment vessel and the degassing vessel so that gas, dissolved in the treatment liquid, is removed therefrom in the degassing vessel in a vacuum atmosphere.

According to a second aspect of the invention, there is provided an ultrasonic treatment apparatus comprising:

a treatment vessel storing a treatment liquid, the treatment vessel having ultrasonic wave-generating means;

a degassing vessel in the form of a sealed vessel communicating with the treatment vessel through a supply pipe and a discharge pipe;

a vacuum pump connected to the degassing vessel;

a discharge pump mounted on the discharge pipe for feeding the treatment liquid from the treatment vessel to the degassing vessel; and a supply pump mounted on the supply pipe for feeding the treatment liquid from the degassing vessel to the treatment vessel.

According to a third aspect of the invention directed to the apparatus of the first or the second aspect, pressure measurement means is provided at the degassing vessel for measuring a pressure within the degassing vessel, and there is provided vacuum pump control means responsive to a result of measurement of the pressure measurement means such that when the pressure reaches a predetermined upper limit level, the vacuum pump control means operates the vacuum pump, and that when the pressure reaches a predetermined lower limit level, the vacuum pump control means stops the operation of the vacuum pump.

According to a fourth aspect of the invention directed to the apparatus of the first, the second or the third aspect, a liquid surface detection means for detecting an upper limit position and a lower limit position of a surface of the treatment liquid is provided at the degassing vessel, and there is provided pump control means for controlling operations of the discharge pump and the supply pump such that when the liquid surface detection means detects the upper limit position, the pump control means makes the liquid feed amount of the supply pump larger than the liquid feed amount of the discharge pump, and that when the liquid surface detection means detects the lower limit position, the pump control means makes the liquid feed amount of the supply pump smaller than the liquid feed amount of the discharge pump.

According to a fifth aspect of the invention directed to the apparatus of any one of the first to fourth aspects, an ultrasonic wave-generating means is provided in the degassing vessel.

In the invention of the first aspect, the treatment liquid stored in the treatment vessel made to cause a cavitation phenomenon by the ultrasonic wave-generating means, and articles immersed in the treatment liquid are cleaned or treated through the cavitation phenomenon. The treatment liquid is fed to the degassing vessel, and further is fed to the treatment vessel in a circulating manner. In the degassing vessel in the form of a vacuum vessel, gas dissolved in the treatment vessel is exposed to the vacuum atmosphere, and is removed as bubbles, so that the treatment liquid containing a reduced amount of the dissolved gas is circulated into the treatment vessel. Therefore, even though ultrasonic vibrations are applied to the treatment liquid by the ultrasonic wave-generating means, bubbles are less produced in the treatment liquid, and the treatment such as a cleaning treatment can be carried out efficiently.

In the invention of the second aspect, the treatment liquid stored in the treatment vessel made to cause a cavitation phenomenon by the ultrasonic wave-generating means, and articles immersed in the treatment liquid are cleaned or treated through the cavitation phenomenon. The treatment liquid is fed to the degassing vessel by the discharge pump through the discharge pipe, and is further fed to the treatment vessel by the supply pump through the supply pipe in a circulating manner. The interior of the degassing vessel in the form of a sealed vessel is kept in a vacuum condition by the vacuum pump, and gas dissolved in the treatment liquid is removed as bubbles, so that the treatment liquid having a reduced amount of the dissolved gas is circulated into the treatment vessel. Therefore, even though ultrasonic vibrations are applied to the treatment liquid by the ultrasonic wave-generating means, bubbles are less produced in the treatment liquid, and the treatment such as a cleaning treatment can be carried out efficiently.

In the invention of the third aspect, gas dissolved in the treatment liquid is removed, so that the gas pressure within the degassing vessel increases. However, the pressure measurement means is provided at the degassing vessel, and when the gas pressure reaches the predetermined upper limit level, the vacuum pump control means is responsive to the measurement result to operate the vacuum pump, thereby keeping the interior of the degassing vessel to a proper vacuum. When the gas pressure within the degassing vessel reaches the predetermined lower limit level, the vacuum pump is stopped.

In the invention of the fourth aspect, the liquid-level upper limit sensor for detecting the upper limit position of the surface of the treatment liquid in the degassing vessel, as well as the liquid-level lower limit sensor for detecting the lower limit position of the surface of the treatment liquid, is provided at the degassing vessel. Therefore, when the surface or level of the treatment liquid in the degassing vessel rises to its upper limit, this is detected by the liquid-level upper limit sensor, and in response to this detection result, the pump control means makes the liquid feed amount of the supply pump larger than the liquid feed amount of the discharge pump, thereby lowering the liquid surface. Also, when the liquid-level lower limit sensor detects the lower limit position, the pump control means controls the operations of the discharge pump and the supply pump to make the liquid feed amount of the supply pump smaller than the liquid feed amount of the discharge pump, so that the liquid surface rises.

In the invention of the fifth aspect, the ultrasonic wave-generating means is provided in the degassing vessel as in the treatment vessel. Therefore, the degassing of the treatment liquid is promoted by a cavitation phenomenon brought about by the generated ultrasonic waves.

In the invention of the first aspect, the ultrasonic treatment apparatus comprises the treatment vessel which stores the treatment liquid, and has the ultrasonic wave-generating means, and the degassing vessel in the form of a vacuum vessel. The treatment liquid is circulated between the treatment vessel and the degassing vessel, so that gas, dissolved in the treatment liquid, is removed therefrom or is minimized in the degassing vessel in a vacuum atmosphere. Therefore, the treatment liquid, degassed in the degassing vessel, is supplied to the treatment vessel in a circulating manner, so that the treatment vessel is always filled with the treatment liquid hardly causing bubbles. Therefore, the cavitation effect by the ultrasonic wave-generating means is achieved effectively, and the treatment (such as cleaning) of the articles to be treated can be carried out effectively.

In the invention of the second aspect, the discharge pump for feeding the treatment liquid from the treatment vessel to the degassing vessel is provided in the discharge pipe, and the supply pump for feeding the treatment liquid from the degassing vessel to the treatment vessel is provided in the supply pipe. Therefore, the circulation of the treatment liquid between the treatment vessel and the degassing vessel can be carried out smoothly, and the treatment vessel is always filled with the treatment liquid hardly causing bubbles. Therefore, the cavitation effect by the ultrasonic wave-generating means is achieved effectively, and the treatment (such as cleaning) of the articles to be treated can be carried out effectively.

In the invention of the third aspect, the pressure measurement means is provided at the degassing vessel, and there is provided the vacuum pump control means responsive to the result of measurement of the pressure measurement means such that when the gas pressure reaches the predetermined upper limit level, the vacuum pump control means operates the vacuum pump, and that when the gas pressure reaches the predetermined lower limit level, the vacuum pump control means stops the operation of the vacuum pump. Therefore, the interior of the degassing vessel can be kept to have a vacuum degree sufficient to effect the degassing.

In the invention of the fourth aspect, the upper liquid-level sensor for detecting the upper limit position of the surface of the treatment liquid, as well as the lower liquid-level sensor for detecting the lower limit position of the liquid surface, is provided at the degassing vessel, and there is provided the pump control means for controlling operations of the discharge pump and the supply pump such that when the liquid-level upper limit sensor detects the upper limit position, the pump control means makes the liquid feed amount of the supply pump larger than the liquid feed amount of the discharge pump, and that when the liquid-level lower limit sensor detects the lower limit position, the pump control means makes the liquid feed amount of the supply pump smaller than the liquid feed amount of the discharge pump. Therefore, the liquid level in the degassing vessel can be kept in the predetermined range.

In the invention of the fifth aspect, in addition to the ultrasonic wave-generating means provided in the treatment vessel, the ultrasonic wave-generating means is provided in the degassing vessel. Therefore, the degassing treatment can be carried out more rapidly, so that the concentration of the dissolved gas in the treatment liquid can be lowered.

Preferably, a vacuum degree of 50 to 150 torr may be used in the vacuum vessel, and the treatment liquid may be water or water containing a surface active agent.

DESCRIPTION OF THE PREFERRED EMBODIMENT

A preferred embodiment of an ultrasonic cleaning apparatus of the present invention in which parts (articles) such as half-sliding bearings, bushes, plates and so on are cleaned by a cleaning liquid (wash water) F will now be described with reference to FIGS. 1 to 3.

Figure 1:
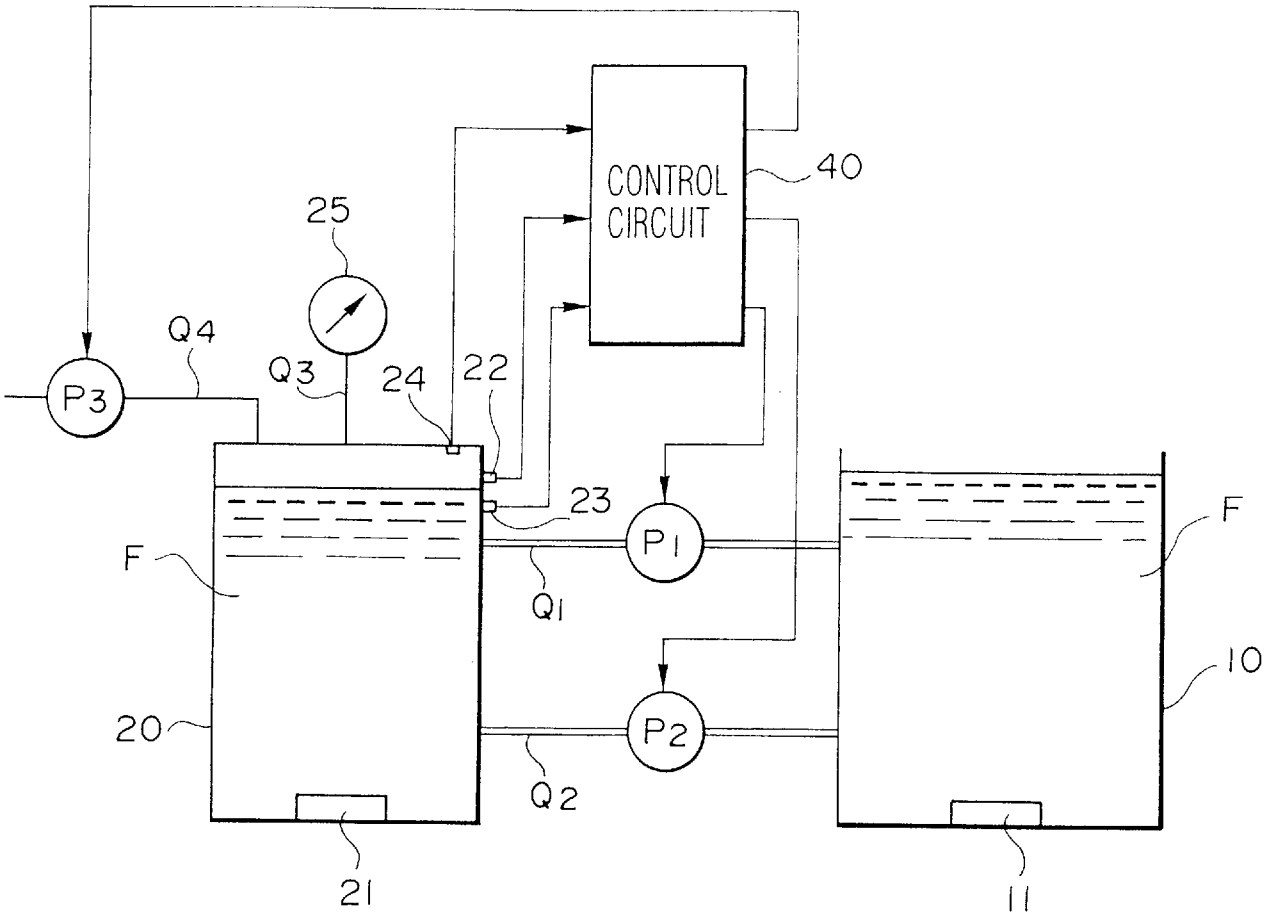
FIG. 1 is a schematic illustration showing an ultrasonic cleaning apparatus of the present invention.

FIG. 1 schematically shows the ultrasonic cleaning apparatus of this embodiment. This ultrasonic cleaning apparatus comprises a cleaning vessel (treatment vessel) 10, a degassing vessel 20 provided parallel to the cleaning vessel 10, and a control circuit 40. A supply pipe Q2 is connected between lower portions of the cleaning vessel 10 and the degassing vessel 20 while a discharge pipe Q1 is connected between upper portions of the two vessels 10 and 20, and the cleaning liquid F flows between the two vessels 10 and 20 through the pipes Q1 and Q2.

The cleaning vessel 10 is open at its top, and a plurality of parts contained in a cage can be introduced into this vessel 10 from the open top. An ultrasonic vibrator 11, driven by a device (not shown) for generating ultrasonic waves, is mounted on an inner surface of a bottom wall of the cleaning vessel 10.

The degassing vessel 20 is in the form of a sealed vessel, and as described above for the cleaning vessel 10, an ultrasonic vibrator 21, driven by a device (not shown) for generating ultrasonic waves, is mounted on an inner surface of a bottom wall of the degassing vessel 20. A liquid-level upper limit sensor 22 is mounted on an upper portion of a side wall of the degassing vessel 20. A liquid-level lower limit sensor 23 is also mounted on the side wall of the degassing vessel 20 at a level lower than the liquid-level upper limit sensor 22. Each of the two sensors 22 and 23 comprises, for example, a photoelectric sensor, but may comprise any other suitable sensor or a limit switch incorporating a float. A gas pressure sensor 24 is mounted on an inner surface of a top or upper wall of the degassing vessel 20. For example, a semiconductor sensor or a piezoelectric sensor is used as the gas pressure sensor 24. A gas pressure gauge 25 is connected to the top wall of the degassing vessel 20 through a pipe Q3 so that the gas pressure within the degassing vessel 20 can be measured from the outside of this vessel.

A vacuum pump P3 is connected to the upper part of the degassing vessel 20 through a pipe Q4. This vacuum pump P3 comprises a non-oil mechanical booster-type pump. An oil rotary pump can be used as the vacuum pump P3, in which case an oil trap should preferably be used to prevent the cleaning liquid from being contaminated by oil. The operation of the vacuum pump P3 is started when the pressure within the degassing vessel 20 exceeds a predetermined upper limit pressure (, for example, 150 torr), and the operation of this pump is stopped when the pressure within the degassing vessel 20 drops below a predetermined lower limit pressure (, for example, 50 torr). The upper limit pressure is determined by the degassing effect, and is set to the above value in the case of the cleaning apparatus using the cleaning liquid F. The lower limit pressure is determined by the evacuating ability of the vacuum pump P3.

The discharge pipe Q1 is connected between the cleaning vessel 10 and the degassing vessel 20, and a discharge pump P1 for feeding the cleaning liquid F from the cleaning vessel 10 to the degassing vessel 20 is mounted on the discharge pipe Q1 at an intermediate portion of the discharge pipe. In order to prevent the cleaning liquid F flowing due to a pressure difference between the cleaning vessel 10 and the degassing vessel 20, the discharge pump P1 comprises a pilot gear-type rotary pump of the positive displacement type in which a rotor is lined with rubber. With this construction, the cleaning vessel 10 and the degassing vessel 20 is hermetically isolated from each other, and the cleaning liquid F can be fed at a predetermined rate in accordance with the rotation of the discharge pump P1. In this embodiment, the discharge pump P1 is set to always rotate at a predetermined constant speed to feed the cleaning liquid F to the degassing vessel 20 at the predetermined rate.

The cleaning vessel 10 and the degassing vessel 20 are connected together by the supply pipe Q2 extending between the lower portions of the side walls of the two vessels 10 and 20. A supply pump P2 for feeding the cleaning liquid F, degassed in the degassing vessel 20, to the cleaning vessel 10 is mounted on the supply pipe Q2 at an intermediate portion of the supply pipe. The supply pump P2 also comprises a pilot gear-type rotary pump in order to prevent a reverse flow of the cleaning liquid F. The supply pump P2 can be increased in rotational speed, and by thus increasing this rotational speed, the amount of supply of the cleaning liquid to the cleaning vessel 10 can be adjusted, and such severe hermetic sealing as required for the discharge pump P1 is not required for the supply pump P2. Therefore, in this embodiment, a rotor of the supply pump P2 is not lined with rubber, which facilitates the maintenance of the supply pump P2.

Figure 2:
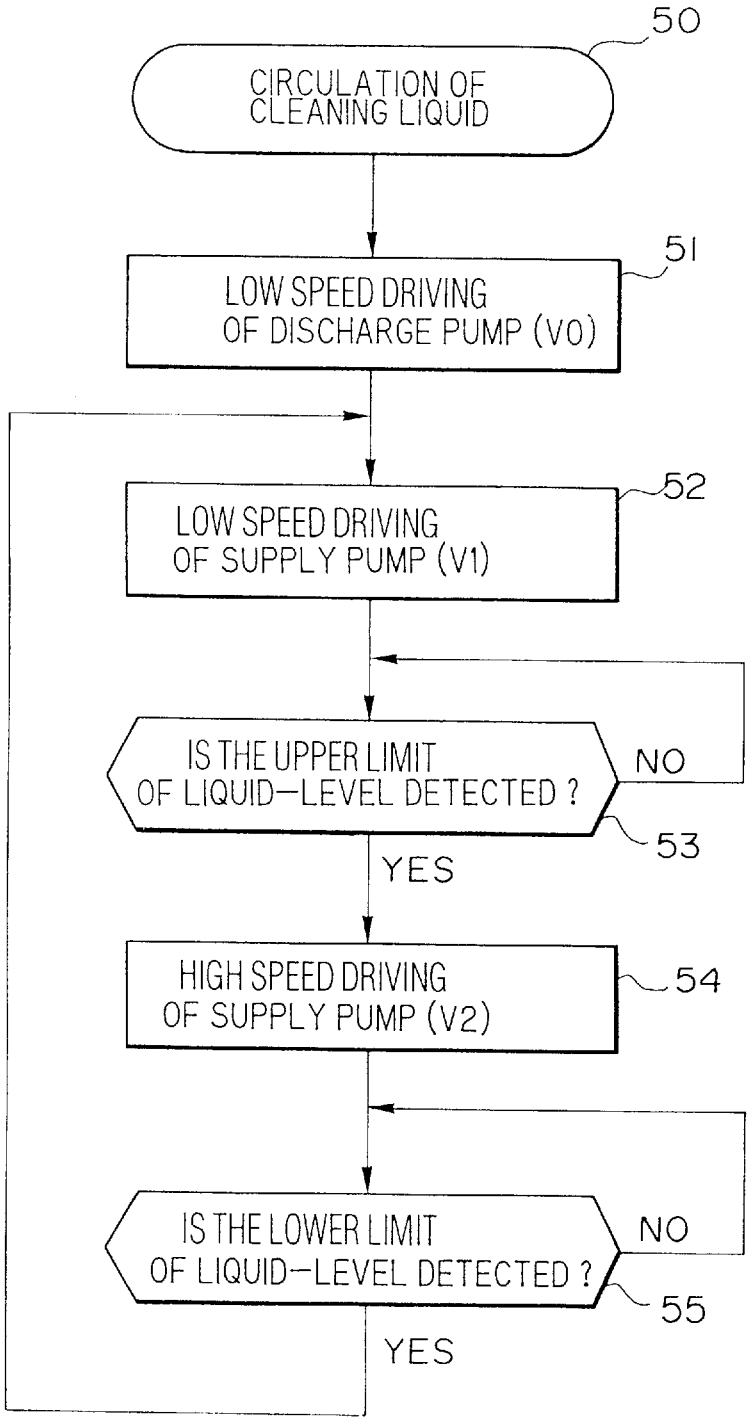
FIG. 2 is a flow chart of a cleaning liquid circulation program.
Figure 3:
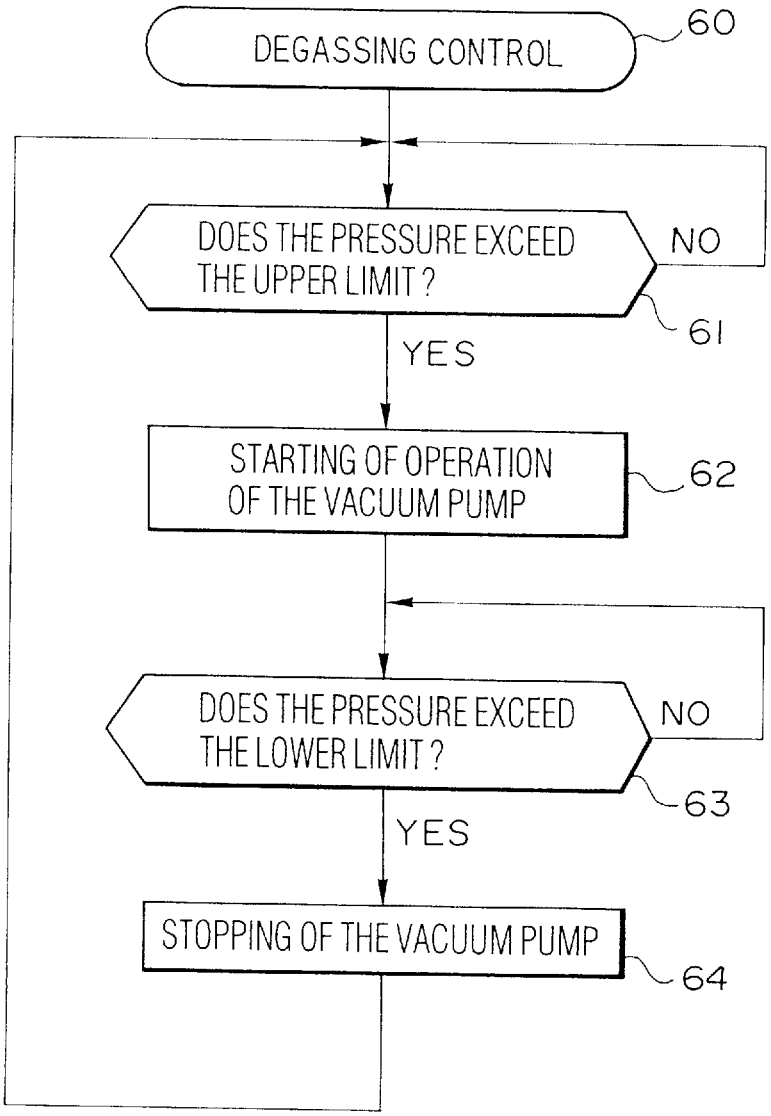
FIG. 3 is a flow chart of a degassing control program.

The control circuit 40 comprises a microcomputer, and continues to execute a cleaning liquid circulation program corresponding to a flow chart of FIG. 2, and also executes an interrupt (i.e., degassing control program) corresponding to a flow chart of FIG. 3.

The pressure sensor 24, the liquid-level upper limit sensor 22 and the liquid-level lower limit sensor 23 are connected to an input side of the control circuit 40. The vacuum pump P3, the discharge pump P1 and the supply pump P2 are connected to an output side of the control circuit 40.

The operation of this embodiment of the above construction will now be described.

The cleaning vessel 10, as well as the degassing vessel 20, holds the cleaning liquid F up to a predetermined liquid-level. In this condition, when a power switch (not shown) is turned on, the ultrasonic vibrators 11 and 21 are driven to produce ultrasonic vibrations of a predetermined frequency, so that articles to be cleaned can be cleaned by a cavitation effect. At the same time, the control circuit 40 starts the processing of the cleaning liquid circulation program in Step 50 of FIG. 2. In Step 51, the discharge pump P1 begins to operate at a constant speed V0. In Step 52, the supply pump P2 begins to operate at a low speed V1 (V1<V0) lower than the speed V0 of the discharge pump P1. As a result, the cleaning liquid F in the cleaning vessel 10 is fed to the degassing vessel 20 at the constant speed V0, and the cleaning liquid F in the degassing vessel 20 is fed or returned to the cleaning vessel 10 at the low speed V1, thus circulating the cleaning liquid F. In this condition, the amount of supply of the cleaning liquid F to the degassing vessel 20 is larger than the amount of discharge of the cleaning liquid F from the degassing vessel 20, so that the liquid-level in the degassing vessel 20 rises.

Then, when the liquid-level of the cleaning liquid F in the degassing vessel 20 reaches the upper limit level, the liquid-level upper limit sensor 22 outputs a detection signal. In response to this detection signal, the control circuit 40 judges in the affirmative ("YES") in Step 53, so that the program proceeds to Step 54 in which the supply pump P2 is switched to the high speed operation V2 (V2>V0) whose speed is higher than that of the discharge pump P1. As a result, the amount of discharge of the cleaning liquid F from the degassing vessel 20 becomes larger than the amount of supply of the cleaning liquid F to the degassing vessel, so that the liquid-level in the degassing vessel 20 drops. Then, when the liquid-level of the cleaning liquid F reaches the lower limit level, the liquid-level lower limit sensor 23 output a detection signal. In response to this detection signal, the control circuit 40 judges in the affirmative ("YES") in Step 55, so that the program is returned to Step 51 in which the supply pump P2 is switched to the low speed operation V1 whose speed is lower than that of the discharge pump P1. Then, the processing from Steps 52 to 55 is repeated, thereby keeping the liquid-level of the cleaning liquid F in the degassing vessel between the upper limit level and the lower limit level. Therefore, there are avoided such disadvantages as the degassing vessel 20 becomes full of the cleaning liquid F, and as the supply pump P2 draws the air as a result of shortage of the cleaning liquid F in the degassing vessel 20.

During the execution of the above cleaning liquid circulation program, the control circuit 40 also executes the interrupt (, that is, the degassing control program) of FIG. 3.

More specifically, the control circuit 40 starts the degassing control program in Step 60, and receives a detection signal from the pressure sensor 24 in Step 61 in which it is judged whether or not the pressure within the degassing vessel 20 is above an upper limit pressure. If the result of this judgment is "YES", the program proceeds to Step 62 in which the operation of the vacuum pump P3 is started. As a result, the interior of the degassing vessel 20 is evacuated into vacuum, so that gas dissolved in the cleaning liquid F makes bubbles, and is removed therefrom. Particularly, with the aid of the cavitation phenomenon caused by the ultrasonic vibrator 21 in the degassing vessel 20, the gas dissolved in the cleaning liquid F efficiently makes bubbles, thereby enhancing the degassing efficiency.

Then, when the pressure within the degassing vessel 20 drops below a lower limit level, the control circuit 40 is responsive to the detection signal from the pressure sensor 24 to cause the program to proceed to Step 64 in accordance with the judgment "YES" in Step 63, thereby stopping the operation of the vacuum pump P3. Thus, when the pressure within the degassing vessel 20 is kept below the upper limit level even if the vacuum pump P3 is not operated, the degassing effect is fully achieved, and the program is returned to Step 61, and the processing from Steps 61 to 64 is repeated.

As described above, the cleaning liquid F (stored in the cleaning vessel 10), which contains the dissolved gas resulting from the air present on the liquid surface and surfaces of the articles to be cleaned, is discharged to the degassing vessel 20 through the discharge pipe Q1. The cleaning liquid F, degassed in the degassing vessel 20, is fed to the cleaning vessel 10 through the supply pipe Q2, and rises from the lower portion thereof, and is again discharged through the discharge pipe Q1, thus effecting the circulation of the cleaning liquid F. When a cage, containing the plurality of articles (parts) to be cleaned, are immersed in the circulating flow of the cleaning liquid, the parts are cleaned by the flow of the cleaning liquid containing a reduced amount of the dissolved gas. In other words, the cleaning liquid to be brought into contact with the surfaces of the parts, contains a reduced amount of the dissolved gas, and therefore directly contacts the surfaces of the parts without producing bubbles by ultrasonic vibration, thereby achieving a highly-efficient cleaning effect.

As described above, the dissolved gas-containing, cleaning liquid F in the cleaning vessel is fed to the degassing vessel 20, and is degassed there, and then is returned to the cleaning vessel 10. Thus, the cleaning liquid F forms the continuous circulating flow, and therefore the cleaning liquid having a reduced amount of the dissolved gas is always stored in the cleaning vessel 10. As a result, the amount of production of bubbles is suppressed by vibrations caused by the ultrasonic vibrators, so that the cleaning of the articles to be cleaned can be effected efficiently.

In this embodiment, although the operation speed of the supply pump P2 is variable while keeping the operation speed of the discharge pump P1 constant, thereby adjusting the liquid-level in the degassing vessel 20, such a construction is not always necessary. The operation speed of the supply pump P2 may be kept constant while rendering the operation speed of the discharge pump P1 variable. Another alternative is that the operation speeds of the two pumps P1 and P2 may be both variable, in which case the liquid-level is adjusted in accordance with the difference between the two operation speeds. It will be apparent from the above discussion that the ultrasonic generators 11 and 21, and the pumps P1, P2, and P3, as well as the means by which these devices are operated and controlled, are all simultaneously operable in the present invention.

In this embodiment, although the control circuit comprises the microcomputer, it may be replaced by an analog sequential control circuit.

In this embodiment, although water is used as the cleaning liquid, a hydrocarbon-type cleaning liquid can be used, and in some cases a solvent-type cleaning liquid can also be used.

The configuration of the ultrasonic cleaning apparatus, the positions of mounting of the supply pipe and the sensors, and so on are not limited to those described in this embodiment, and these can be suitably changed or modified depending on the purpose and application.

What is claimed is:

1. An ultrasonic treatment apparatus comprising:

a treatment vessel including means for storing a treatment liquid, said treatment vessel comprising an ultrasonic wave-generating means;

a degassing vessel including vacuum means for degassing the treatment liquid;

means for circulating said treatment liquid between said treatment vessel and said degassing vessel such that gas, dissolved in said treatment liquid, is removed therefrom in said degassing vessel in a vacuum atmosphere; and operating means for simultaneously operating the ultrasonic wave-generating means in the treatment vessel, the degassing vessel, and the means for circulating said treatment liquid, said operating means including a pressure measurement sensor;

whereby the ultrasonic treatment is continuously performed while operating the degassing vessel.

2. Apparatus according to claim 1, in which the pressure measurement sensor is provided at said degassing vessel for measuring a pressure within said degassing vessel, and there is provided vacuum pump control means responsive to a result of measurement of said pressure measurement sensor such that when said pressure reaches a predetermined upper limit level, said vacuum pump control means operates the vacuum pump, and that when said pressure reaches a predetermined lower limit level, said vacuum pump control means stops the operation of said vacuum pump.

3. Apparatus according to claim 2, further comprising liquid surface detection means for detecting an upper limit position and a lower limit position of a surface of said treatment liquid in said degassing vessel, and pump control means for controlling operations of said discharge pump and said supply pump such that when said liquid surface detection means detects the upper limit position, said pump control means makes the liquid feed amount of said supply pump larger than the liquid feed amount of said discharge pump, and that when said liquid surface detection means detects the lower limit position, said pump control means makes the liquid feed amount of said supply pump smaller than the liquid feed amount of said discharge pump.

4. Apparatus according to claim 3, further comprising ultrasonic wave-generating means provided in said degassing vessel.

5. Apparatus according to claim 2, further comprising ultrasonic wave-generating means provided in said degassing vessel.

6. Apparatus according to claim 1, further comprising liquid surface detection means for detecting an upper limit position and a lower limit position of a surface of said treatment liquid in said degassing vessel, and pump control means for controlling operations of a discharge pump and a supply pump such that when said liquid surface detection means detects the upper limit position, said pump control means makes the liquid feed amount of said supply pump larger than the liquid feed amount of said discharge pump, and that when said liquid surface detection means detects the lower limit position, said pump control means makes the liquid feed amount of said supply pump smaller than the liquid feed amount of said discharge pump.

7. Apparatus according to claim 6, further comprising ultrasonic wave-generating means provided in said degassing vessel.

8. Apparatus according to claim 1, further comprising another ultrasonic wave-generating means provided in said degassing vessel.

9. The apparatus according to claim 1, wherein the treatment liquid comprises water.

10. An ultrasonic treatment apparatus comprising:

a treatment vessel storing a treatment liquid, said treatment vessel comprising an ultrasonic wave-generating means;

a degassing vessel in the form of a sealed vessel communicating with said treatment vessel through a supply pipe and a discharge pipe;

a vacuum pump connected to said degassing vessel;

a discharge pump mounted on said discharge pipe for feeding said treatment liquid from said treatment vessel to said degassing vessel;

a supply pump mounted on said supply pipe for feeding said treatment liquid from said degassing vessel to said treatment vessel; and operating means for simultaneously operating the ultrasonic wave-generating means in the treatment vessel, the vacuum pump, the discharge pump, and the supply pump, said operating means including a pressure measurement sensor in the degassing vessel;

whereby the ultrasonic treatment is continuously performed while degassing.

11. Apparatus according to claim 10, in which pressure measurement means is provided at said degassing vessel for measuring a pressure within said degassing vessel, and there is provided vacuum pump control means responsive to a result of measurement of said pressure measurement means such that when said pressure reaches a predetermined upper limit level, said vacuum pump control means operates the vacuum pump, and that when said pressure reaches a predetermined lower limit level, said vacuum pump control means stops the operation of said vacuum pump.

12. Apparatus according to claim 11, further comprising liquid surface detection means for detecting an upper limit position and a lower limit position of a surface of said treatment liquid in said degassing vessel, and pump control means for controlling operations of said discharge pump and said supply pump such that when said liquid surface detection means detects the upper limit position, said pump control means makes the liquid feed amount of said supply pump larger than the liquid feed amount of said discharge pump, and that when said surface detection means detects the lower limit position, said pump control means makes the liquid feed amount of said supply pump smaller than the liquid feed amount of said discharge pump.

13. Apparatus according to claim 12, further comprising ultrasonic wave-generating means-provided in said degassing vessel.

14. Apparatus according to claim 10, further comprising ultrasonic wave-generating means provided in said degassing vessel.

15. Apparatus for cleaning articles by use of ultrasonic waves, comprising:

a cleaning vessel adapted to receive the articles to be cleaned, said cleaning vessel being provided therein with a cleaning liquid and means for generating ultrasonic waves such that the articles immersed in the cleaning liquid are cleaned by a cavitation phenomenon occurring during the application of the ultrasonic waves onto the articles;

a degassing vessel including means to be operatively connected to both a vacuum pump and the cleaning vessel such that an amount of gas dissolved in the cleaning liquid transferred from the cleaning vessel into the degassing vessel is minimized;

means for circulating the cleaning liquid between the cleaning vessel and the degassing vessel;

means for controlling both a level of the cleaning liquid received in the degassing vessel and a pressure range of gas contained in the degassing vessel; and operating means for simultaneously operating the means for generating an ultrasonic wave, the means to be operatively connected, the means for circulating the cleaning liquid, and the means for controlling, said operating means including a pressure measurement sensor;

whereby the articles are continuously cleaned.

16. Apparatus according to claim 15, said cleaning liquid being one selected from the group consisting of water, hydrocarbon and solvents.

17. Apparatus according to claim 15, said means for circulating the cleaning liquid between the cleaning vessel and the degassing vessel being provided with a pipe connecting the upper parts of both the cleaning vessel and the degassing vessel, and another pipe connecting the lower parts of both the cleaning vessel and the degassing vessel, each of said pipes being provided therein with a pump for transferring the cleaning liquid.

18. Apparatus according to claim 17, said means for controlling both a level of the cleaning liquid received in the degassing vessel and a pressure range of gas contained in the degassing vessel being provided with:

pressure measurement means located at an upper part of the degassing vessel which pressure measurement means measures a pressure within the degassing vessel;

a vacuum pump operatively connected to the degassing vessel;

vacuum pump control means responsive to a result of measurement of said pressure measurement means so that a degree of vacuum is kept in a predetermined range in the degassing vessel;

liquid surface detection means for detecting each of upper and lower limit positions of said cleaning liquid, said liquid surface detection means being a provided at an upper portion of said degassing vessel;

a discharge pump for discharging said liquid from the cleaning vessel into the degassing vessel and a supply pump for supplying said liquid from the degassing vessel into the cleaning vessel, said discharge pump being provided in said pipe connecting the upper parts of both the cleaning vessel and the degassing vessel, said supply pump being provided in said another pipe connecting the lower parts of both the cleaning vessel so that the cleaning liquid is circulated between the cleaning vessel and the degassing vessel; and pump control means for controlling operation of said discharge pump and said supply pump so that, when said liquid surface detection means detects the upper limit position of said liquid, said pump control means makes a liquid feed amount of said supply pump larger than a liquid discharge amount of said discharge pump and so that, when said liquid surface detection means detects the lower limit position of said liquid, said pump control means makes a liquid feed amount of said supply pump smaller than a liquid discharge amount of said discharge pump.

19. Apparatus according to claim 18, said degree of vacuum kept in the degassing vessel being in a range from 50 to 150 torr.

20. Apparatus according to claim 15, said degassing vessel further comprising means for generating ultrasonic wave in said cleaning liquid received in said degassing vessel.

* * * * *